US008656900B1

(12) United States Patent
Kronengold et al.

(10) Patent No.: US 8,656,900 B1
(45) Date of Patent: Feb. 25, 2014

(54) BOW ENERGY TRANSFER SYSTEM AND METHOD

(75) Inventors: David H. Kronengold, Tucson, AZ (US); Allen C. Rasor, Jr., Marana, AZ (US); Kevin L. Hansen, Tucson, AZ (US); Ronald C. Grimes, Vail, AZ (US); John M. Liska, Jr., Oracle, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 173 days.

(21) Appl. No.: 13/033,045

(22) Filed: Feb. 23, 2011

(51) Int. Cl.
*F41B 5/00* (2006.01)

(52) U.S. Cl.
USPC ..... 124/90; 124/86; 124/92

(58) Field of Classification Search
None
See application file for complete search history.

(56) References Cited

U.S. PATENT DOCUMENTS

| | | | | |
|---|---|---|---|---|
| 3,756,214 | A | 9/1973 | Christen | |
| 3,837,327 | A | 9/1974 | Saunders et al. | |
| 3,969,825 | A | 7/1976 | Mathes | |
| 4,080,951 | A | 3/1978 | Bateman, III | |
| 5,979,427 | A * | 11/1999 | Chalin et al. | 124/87 |
| 6,679,242 | B1 * | 1/2004 | Martin | 124/90 |
| 7,363,921 | B2 | 4/2008 | Kempf | |
| 7,434,574 | B2 | 10/2008 | McPherson | |
| 7,584,750 | B2 | 9/2009 | Chang | |
| 7,624,725 | B1 | 12/2009 | Choma | |
| 2009/0300962 | A1 * | 12/2009 | Bentley | 42/73 |

FOREIGN PATENT DOCUMENTS

| | | | | |
|---|---|---|---|---|
| DE | 3405319 | * | 6/1984 | F41B 5/14 |

* cited by examiner

*Primary Examiner* — Gene Kim
*Assistant Examiner* — John E Simms, Jr.
(74) *Attorney, Agent, or Firm* — Cahill Glazer PLC

(57) ABSTRACT

A bow energy transfer system includes a pair of helically wound springs positioned on the bowstrings on either side of the bowstring nock point; the springs are secured to the bowstring with a serving thread wound between the individual coils into contact with the bowstring. The springs flex perpendicular to their longitudinal axes during discharge of the bow causing energy to temporarily be stored in the flexed spring to be returned to the arrow or bolt later in its discharge.

6 Claims, 2 Drawing Sheets

BOW ENERGY TRANSFER SYSTEM AND METHOD

FIELD OF THE INVENTION

The present invention pertains to archery bows and systems, and particularly to systems having a high draw weight wherein the transfer of energy from flexed limbs to an arrow or bolt may be enhanced by the addition of mass to the bowstring.

BACKGROUND OF THE INVENTION

High powered archery bows, that is, bows and crossbows with high draw weight, must efficiently deliver the substantial stored energy in flexed limbs through the bowstring to the arrow or bolt. The smooth and efficient delivery of the potential energy stored in the flexed limbs to the arrow, to produce kinetic energy in the form of motion of the arrow, is difficult to achieve and usually results in residual energy remaining in the bow system after the arrow's departure that is dissipated in the form of vibration, noise, and in some instances can result in the generation of a bowstring shockwave propagating along the bowstring to the cams of the system causing the bowstring to derail and jump off the cam track. That is, the high forces being transmitted to the bowstring during bowstring release may result in the propagation of a standing wave along the length of the bowstring resulting in the bowstring derailing from the groove of the cam or wheel. These difficulties are particularly acute with crossbows.

It is known in the prior art that the transfer of energy from bowstring to the arrow or bolt may be more efficiently accomplished by adding mass to the bowstring. This addition of mass to the bowstring typically incorporates the clamping of C-shaped brass nock sets to the bowstring on either side of the nock point of the bowstring. These brass nock sets come in a variety of weights and are usually clamped to the bowstring by deforming the brass into a grasping position against the bowstring. It is believed that the addition of the mass somewhat slows the acceleration of the arrow or bolt but the force is more efficiently transferred from the limbs through the bowstring to the arrow. In high powered compound bows, and particularly with crossbows, the violence accompanying the release of the bowstring and the transfer of energy from the limbs to the arrow may result in forces acting upon the weights that cause them to move along the length of bowstring and thus change their position (and the characteristics and effect of the added mass) and in some instances may even be dislodged from the bowstring resulting in a dangerous condition wherein the dislodged weight, traveling at a high rate of speed, may strike the archer or a spectator.

Other types and styles of mass increasing devices have been proposed in the prior art including the utilization of rubber, plastic or other polymer weights in the form of sleeves that are threadedly positioned on the bowstring at strategic locations. These polymer weights grasp the bowstring through the elasticity of the polymer; however, the violence of the release of the bowstring temporarily and radically deforms these polymer weights resulting in the loss of precise positioning of the weight and in some cases destruction of the weight. Further, it is difficult to achieve sufficient mass through the utilization of polymer weights.

SUMMARY OF THE INVENTION

The present invention strategically places additional mass at locations on the bowstring on either side of the bowstring nock point. The mass takes the form of helical extension springs formed of metal having an inside coil diameter slightly larger than the outside diameter of the bowstring. The helical springs are positioned on the bowstring and add mass to accomplish the increase in efficiency of the transfer of energy from the bow limbs to the arrow or bolt. The helical springs completely encircle the bowstring and therefore cannot be dislodged during the discharge of the bow regardless of the violence of the energy transfer. Further, the helical springs are flexed perpendicular to their longitudinal axis during the bowstring travel from full draw to arrow or bolt release. The flexing of the helical springs in this manner has been found to result in increased efficiency and an increase in bolt or arrow speed for a given draw weight. Additionally, the helical springs are secured in position on the bowstring through the utilization of serving wound between individual coils of the spring into contact with the bowstring; the extension of the individual coils to accept the serving there between results in a force exerted by the extension spring on the serving to press the serving firmly against the bowstring and the spring to lock the spring in position.

BRIEF DESCRIPTION OF THE DRAWINGS

The present invention may more readily be described by reference to the accompanying drawings in which.

DETAILED DESCRIPTION OF THE INVENTION

Figure 1:
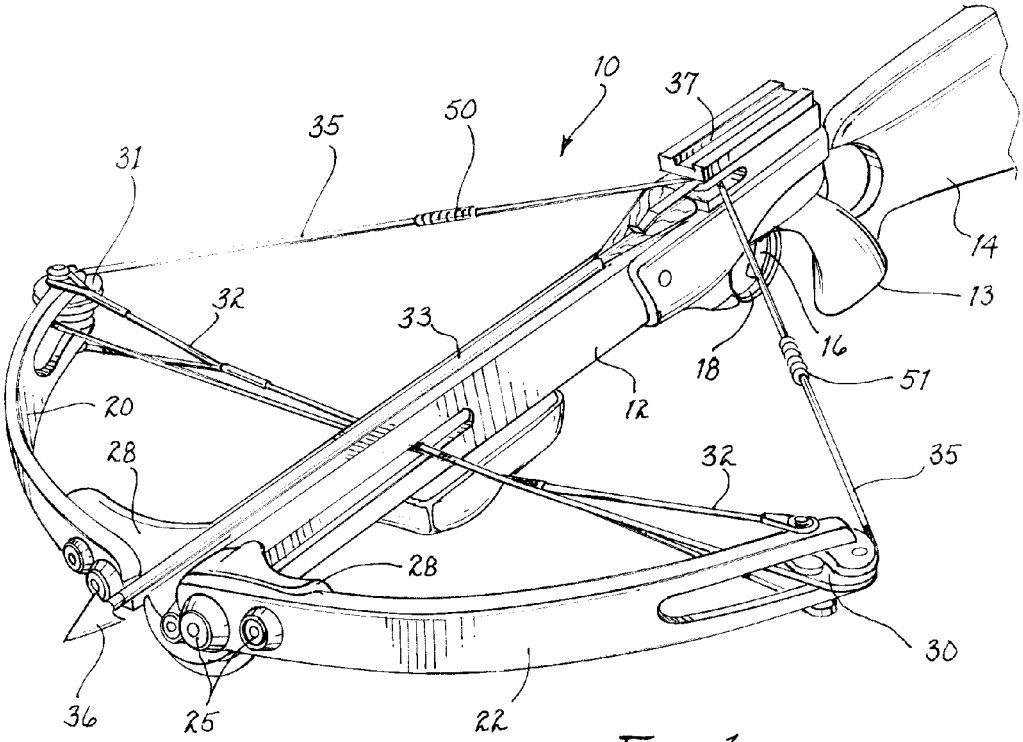
FIG. 1 is an isometric view of a crossbow constructed in accordance with the teachings of the present invention and showing the crossbow in a full draw position.
Figure 2:
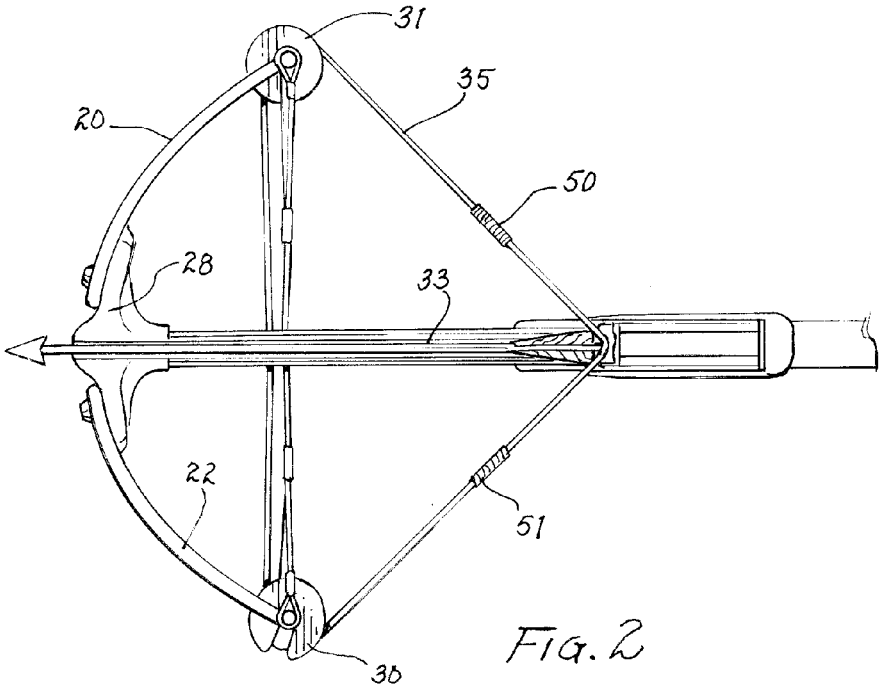
FIG. 2 is a top view of the crossbow shown in FIG. 1.

Referring to FIGS. 1 and 2, an archery bow 10 constructed in accordance with the teachings of the present invention is shown. The archery bow system shown in FIGS. 1 and 2 is a crossbow; however, the present invention is equally applicable to compound bows, and particularly to bows, crossbows or compound bows, that have a high draw weight. The crossbow is provided with a stock forearm 12 that includes a grip 13 and a stock butt 14. A trigger 16 and a trigger guard 18 are provided to permit the crossbow to be discharged. The crossbow system includes limbs 20 and 22 secured by limb bolts 25 to a riser 28 which in turn is secured to the stock 12. As used herein, the term riser includes other terms that may be used for the support used for mounting the limbs; in crossbow terminology, the riser is sometimes referred to as a retainer, a prod, or a mounting bracket. The limbs each support a cam 30 or a wheel 31 and provide anchor points for cables 32 extending from the cam or wheel to the opposite limb. A bowstring 35 extends from the wheel or cam to the opposing cam and may be drawn to engage a release mechanism, mounted within the stock, to secure the bowstring in the full draw position. The bowstring engages the nock of an arrow or bolt 38 which may be provided with a broadhead 36 for hunting. In the example shown in FIG. 1, a sight mounting block 37 may be provided to support any of several sighting systems. Actuation of the trigger 16 by the archer activates the release mechanism to disengage the bowstring 35 and thus begin the transfer of energy stored in the flexed limbs 20, 22 to the bolt 33 through the bowstring 35 in a well known manner.

Figure 5:
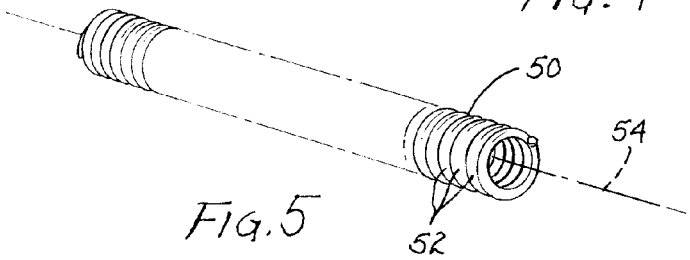
FIG. 5 is an isometric view of an extension spring suitable for use in the system of the present invention.

The present invention incorporates predetermined weights or mass devices 50 and 51 that are strategically positioned along the length of the bowstring on either side of the nocking point of the bowstring. The mass or weights 50, 51 may best be seen by reference to FIGS. 5, 6 and 7 wherein it may be seen that the weight 50 comprises a helical spring having a plurality of coils 52, formed of a single wire strand, that extend along a longitudinal axis 54. The spring is of the extension spring-type wherein the individual coils 52 of the spring are normally in contact with adjacent coils when the spring is at rest. The weight or mass in the form of the helically coiled spring is installed on the bowstring by passing the bowstring through the inside of the spring along the longitudinal axis 54 of the spring; the inside diameter of the coil spring is chosen to be slightly larger than the outside diameter of the bowstring 35 to permit the spring to be moved along the bowstring to a selected position. The bowstring may be provided with serving in the well known manner wherein the bowstring is formed using selected internal threads wrapped with serving material or threads in a manner well known in the art.

Figure 6:
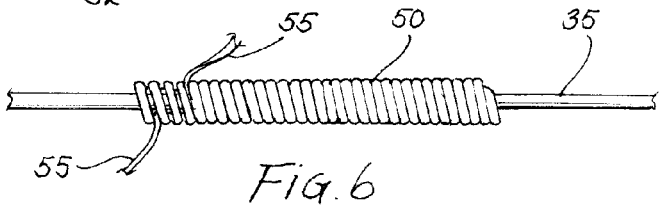
FIG. 6 is a side elevational view of an extension spring mounted on a bowstring showing the initial wrapping of serving between successive coils of the spring.
Figure 7:
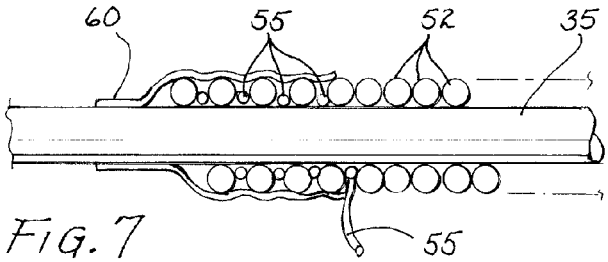
FIG. 7 is a side elevational view, partly in section, of a bowstring showing the coils of an extension spring mounted thereon with serving between successive coils and in contact with the bowstring, and showing shrink tubing covering the assembly of the spring and serving.

The spring 50 is thus positioned on the bowstring 35 and secured in place by wrapping serving thread 55 between the individual coils of the spring 52 so that the serving cord or thread extends between the individual coils into contact with the bowstring as shown in FIGS. 6 and 7. The extension spring 50 at rest normally incorporates successive or adjacent coils in contact with each other. These coils are maintained in intimate contact with adjacent coils until a predetermined initial tension is applied to the coils by extending the extension spring. When the serving material or threads 55 are wrapped between the individual coils 52, the coils are forced apart and exert a compression force on the serving threads forcing the threads into intimate contact with the bowstring and wedging the threads between adjacent coils with a force that presses the thread against the surface of the bowstring. The slight extension of the extension spring caused by the insertion of the serving thread between successive coils results in a gripping force exerted by the spring against the serving thread forcing the latter into intimate and secure contact with the bowstring. As a result of this gripping force, the spring is securely positioned on the bowstring and is locked to that position preventing movement longitudinally along the bowstring. When the extension spring 50 has been appropriately secured to the bowstring 35 through the insertion of serving threads 55 between adjacent coils 52 into contact with the bowstring, the assembly may be protected from moisture and debris by covering the spring with a shrink tubing 60 thus covering the spring, inter-coil serving, and bowstring at the location of the added mass. The end result is the positioning of an appropriate mass, at a location along the length of the bowstring, incorporating an extension spring secured to the bowstring through the utilization of serving threads positioned between the individual coils locked into gripping contact with the bowstring by the force exerted by the spring coils. When thus mounted on the bowstring, the coil is firmly secured to the bowstring and will not move longitudinally on the bowstring but will nevertheless be free to flex or bend perpendicularly to its longitudinal axis. Further, and importantly, the mass (spring) cannot be dislodged from the bowstring regardless of the violence that frequently accompanies the discharge of a high draw weight archery system.

Figure 3:
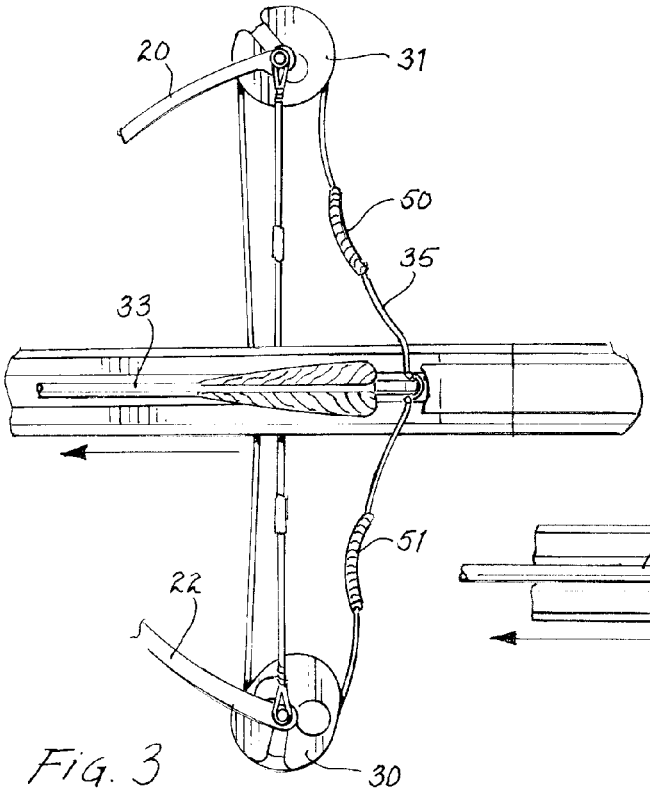
FIG. 3 is a top view of a portion of the crossbow of FIG. 2 showing the position of the bolt, bowstring and extension springs as the bolt is being accelerated after discharge with the respective positions occurring approximately 1½" brace height.
Figure 4:
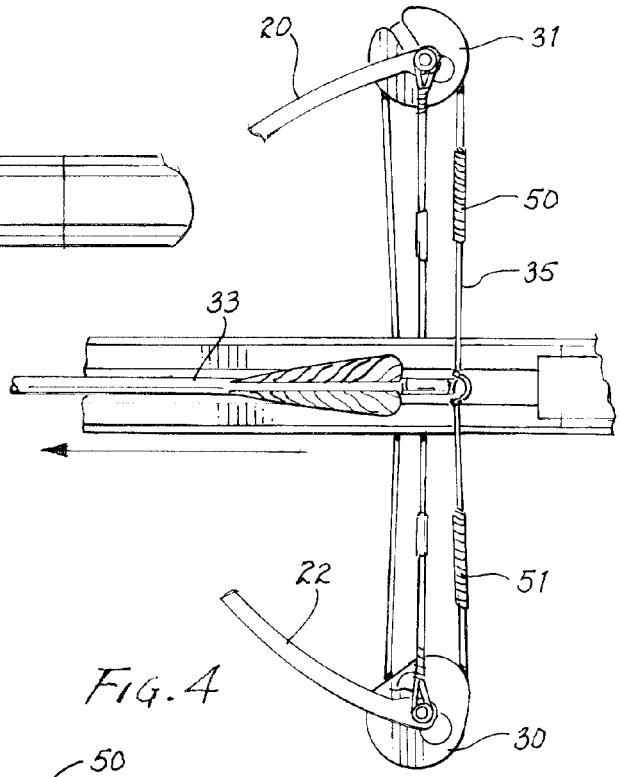
FIG. 4 is a top view of a portion of the crossbow of FIG. 2 showing the position of the bolt, bowstring, and extension springs at the moment the bolt leaves contact with the bowstring.

The archery bow, or crossbow, as shown in FIGS. 1 and 2 is presented in a full draw position. That is, the bowstring has been withdrawn to its full position and has been locked in that position by engagement with a release mechanism mounted within the stock of the crossbow in a manner well known in the art. The limbs are thus flexed to their maximum kinetic energy storage position and the bolt or arrow is positioned with its nock engaging the bowstring. When the trigger is depressed, the bowstring is released and the energy transfer from the flexed limbs to the bolt or arrow begins. The energy is transmitted through the bowstring to the nock of the arrow; as the arrow and bowstring move to the left from the position shown in FIGS. 1 and 2, it has been found that the bowstring flexes along its axis from a straight position such as shown in FIG. 1 to a curved position such as shown in FIG. 3. The bowstring and bolt or arrow shown in FIG. 3 represent a position of those elements as the arrow is being accelerated and located at the instant shown in FIG. 3 approximately 1.5" from the bowstring position at brace height. It may be noted that the springs 50 and 51 have also assumed a bent or curved position at this point of arrow travel; the springs have been flexed in a direction or directions perpendicular to their longitudinal axes. This perpendicular flexing is a representation of the storage of absorbed energy derived from the system as the bowstring transfers energy from the limbs to the arrow. This temporary storage of energy in the form of flexed springs represents the temporary storage of energy as the arrow is accelerating with the subsequent return of the stored energy from the springs to the arrow through the bowstring. Thus, as the arrow leaves contact with the bowstring as shown in FIG. 4, it may be seen that the flexed springs have returned to a straightened position and the stored energy represented by the flexed springs has been returned to the arrow at a point late in its acceleration with the bowstring. Thus, the temporary storage of a portion of the energy being transferred from the flexed limbs through the bowstring, and the subsequent return of that temporarily stored energy portion to the bowstring later in the acceleration path of the arrow has been found to provide unexpected benefits. First, the flexing of the springs and the absorption of energy with the return of that energy later in the arrows travel prevents the generation of standing waves in the bowstring with the resulting derailment of the bowstrings from the corresponding cam or wheel tracks. A second benefit resulting from the flexing of the springs is the increased efficiency of the transfer of the energy from the flexed bows to the arrow; this increased efficiency is presented in the form of an increase in arrow or bolt velocity. It has been found that for a bow system with otherwise fixed parameters such as draw weight, length of power stroke, cam design, bolt or arrow weight, and other parameters, the inclusion of the coil spring weights as described above provides increased arrow or bolt velocity and elimination of bowstring standing waves that may derail the bowstrings from the cam tracks.

The spring is preferably formed of metal wire, and may be made of a spring steel such as music wire. The spring is thus formed of a continuously wound single strand of wire having the desired inside coil diameter to accept the bowstring within the coil spring along its longitudinal axis. The inside coil diameter is chosen to be slightly larger than the outside diameter of the bowstring. It has been found that commercially available extension springs formed of music wire are most appropriate. In one example, springs were formed of music wire having a wire diameter of 0.05" formed into a helical coil with approximately 36 coils and having an inside diameter of 0.132" and an outside diameter of 0.232". The overall length of each spring was approximately 1.85". A pair of such springs were mounted on a bowstring of a type that is readily available in the industry and had an outside diameter of 0.120". The springs were threaded onto the bowstring and positioned approximately 4" on either side of the nocking point of the bowstring. The optimum position for the springs was empirically determined. The spring formed as above is commercially available and incorporates specifications of initial tension of four to eight pounds and a spring rate of thirty-two to forty-eight pounds per inch. The nominal weight of the springs is 80 grains. The precise dimensions such as weight and the like will obviously be chosen in accordance with the requirements of the particular archery system with which the weights are to be used.

The springs were secured in position on the bowstring by threading a continuous link of small, strong string between each coil of the spring. The thread chosen was commercially available and was selected from serving material that is used in other applications in the construction of archery systems. The particular serving thread material used in this application was available and known as BCY 0.021 #62XS. The single thread was wound between each of the adjacent coils of the spring into contact with the bowstring. The clamping force exerted on the thread by the individual coils when the thread is positioned as described resulted in the locking of the spring in the desired position on the bowstring.

A crossbow was chosen and the springs formed and positioned as indicated above were placed on the bowstring. It was found that the resulting bolt velocity had increased, the bowstring remained firmly within the cam grooves and the weights remained precisely as originally positioned throughout several such trials.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. An archery bow having a pair of flexible limbs extending from a riser, a cam rotatably mounted at an end of one of said limbs and a cam or wheel mounted at an end of the other of said limbs, a bowstring extending between the cam and cam or wheel and having a nocking point for contacting the nock of a projectile to accelerate the projectile away from said bow, a pair of helically wound metal extension springs mounted on said bowstring each having a longitudinal axis coincident with said bowstring and each having adjacent coils in contact with each other, and coils in constricting contact with said bowstring, said extension springs positioned an equal distance on either side of the nocking point respectively, a serving thread wound between adjacent coils of each extension spring into contact with said bowstring to secure each extension spring in place, the serving thread in contact with said bowstring and contacting adjacent coils of said extension spring to force them apart and to provide a gripping force exerted by said adjacent coils against the serving thread to force the serving thread into secure contact with the bowstring.

2. The archery bow of claim 1 wherein said metal extension spring is formed of music wire.

3. The archery bow of claim 2 wherein said serving thread is a single continuous serving thread.

4. In an archery bow having a riser, a pair flexible limbs extending from said riser, a cam rotatably mounted at an end of one of said limbs and a cam or wheel mounted at an end of the other of said pair of limbs, a bowstring extending between the cam and cam or wheel and having a nocking point for contacting the nock of a projectile to accelerate the projectile away from said bow, the improvement comprising:

(a) a pair of helically wound extension springs mounted on said bowstring each having a longitudinal axis coincident with said bowstring and each comprising a plurality of coils, each coil contacting an adjacent coil and each coil in constricting contact with said bowstring;

(b) said springs positioned on either side of the nocking point, respectively, and at equal distances therefrom; and (c) each of said springs secured to said bowstring by serving thread wound between adjacent coils into contact with the bowstring and contacting adjacent coils of said extension spring to force them apart and provide a gripping force exerted by said adjacent coils against the serving thread to force the serving thread into secure contact with the bowstring.

5. The archery bow of claim 4 wherein said metal extension spring is formed of music wire.

6. The archery bow of claim 4 wherein said serving thread is a single continuous serving thread.

* * * * *